US007455108B2

(12) United States Patent
Jenkins et al.

(10) Patent No.: US 7,455,108 B2
(45) Date of Patent: Nov. 25, 2008

(54) RADIO FREQUENCY TAGS FOR TURBULENT FLOWS

(75) Inventors: Charles Jenkins, Mawson (AU); Michael Barrett, Cambridgeshire (GB); Harry Barrow, Cambridgeshire (GB); Paul Dickenson, Hertfordshire (GB); Ashley Johnson, Cambridgeshire (GB)

(73) Assignee: Schlumberger Technology Corporation, Ridgefield, CT (US)

( * ) Notice: Subject to any disclaimer, the term of this patent is extended or adjusted under 35 U.S.C. 154(b) by 309 days.

(21) Appl. No.: 11/143,351

(22) Filed: Jun. 2, 2005

(65) Prior Publication Data

US 2006/0000604 A1 Jan. 5, 2006

(30) Foreign Application Priority Data

Jun. 9, 2004 (GB) ..... 0412927.6

(51) Int. Cl.
*E21B 47/00* (2006.01)
*E21B 47/12* (2006.01)

(52) U.S. Cl. ..... 166/250.11; 166/250.01; 175/40

(58) Field of Classification Search ..... 166/250.11, 166/250.01, 66, 242.1, 250.12; 175/40
See application file for complete search history.

(56) References Cited

U.S. PATENT DOCUMENTS 6,234,257 B1 * 5/2001 Ciglenec et al. ..... 175/50
6,241,028 B1 * 6/2001 Bijleveld et al. ..... 175/40
6,324,904 B1 * 12/2001 Ishikawa et al. ..... 73/152.03
6,360,823 B1 * 3/2002 Ranson et al. ..... 166/381
6,400,274 B1 * 6/2002 Duan et al. ..... 340/572.7
6,443,228 B1 9/2002 Aronstam et al.
6,446,736 B1 9/2002 Kruspe et al.
6,931,952 B2 * 8/2005 Rantala et al. ..... 73/866.5
2002/0185275 A1 12/2002 Yang et al.
2004/0020636 A1 2/2004 Kenison et al.
2004/0020643 A1 2/2004 Thomeer et al.

FOREIGN PATENT DOCUMENTS

| | | | |
|---|---|---|---|
| EP | 1069526 | A2 | 1/2001 |
| GB | 1549307 | | 7/1976 |
| GB | 2352041 | B | 1/2002 |
| GB | 2352042 | B | 4/2002 |
| GB | 2396170 | A | 6/2004 |
| WO | 99/66172 | | 12/1999 |
| WO | 01/04660 | A1 | 1/2001 |
| WO | 01/04661 | A2 | 1/2001 |

* cited by examiner

*Primary Examiner*—David J. Banell
*Assistant Examiner*—David Andrews
(74) *Attorney, Agent, or Firm*—Steven Gahlings; James McAleenan; Jody Lynn DeStefanis

(57) ABSTRACT

A system for communicating information, particular for use in a hydrocarbon well, is described including one or more releasable vessels having radio frequency (RF) circuitry responsive, when in use, to an RF reader system, the vessel including counteracting means to reduce the effect of destabilizing flow forces thereby extending the coupling time with the reader system.

16 Claims, 9 Drawing Sheets

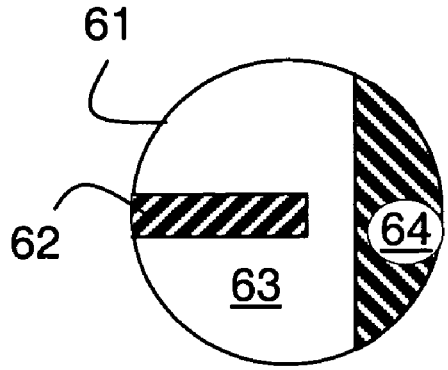
FIG. 6A
FIG. 6B
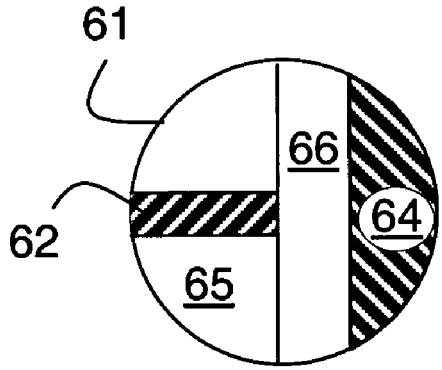
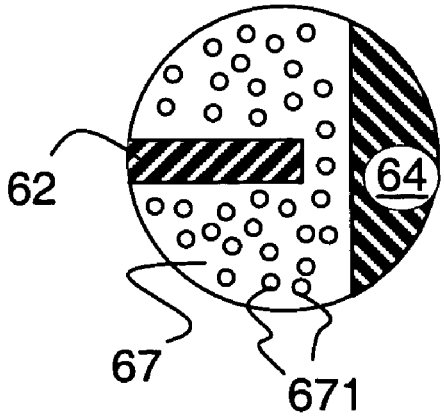
FIG. 6C

RADIO FREQUENCY TAGS FOR TURBULENT FLOWS

This application claims priority from United Kingdom Patent Application No. 0412927.6, filed Jun. 9, 2004.

The present invention generally relates to apparatus and methods for transmitting information using a radio frequency transponder in a turbulent flow environment. More specifically, it relates to such apparatus and methods to carry information through a flow of well bore effluents.

BACKGROUND OF THE INVENTION

Radio frequency identification (RFID) tags are found in an ever-increasing number of applications within a wide variety of different environments. Within the oilfield such tags can be used to identify equipment and/or transfer information along the well bore. The use of RFID tags in well bore flows poses a number of challenges not encountered in the field of inventory control and device tracking where such tags are commonly applied.

The flow of effluents from the well bore is often turbulent and the effluents may consist of multiple phases such as hydrocarbons, water and gas. RFID tags are convected along in the flow of the produced fluids. At a surface location the tags are energized and read with an appropriate reader antenna. The lack of orientation of a device free to move within the flow, the temperature of the flow, and the metal pipe surrounding the flow are all factors that either alone or jointly prevent the use of most of the known RFID tags. For example, known tags often have simple antennas with a directional characteristics. In conventional inventory control systems it is possible to overcome this problem by controlling the orientation. For most of these known systems it can be assumed that the tag does not change its orientation during the read-out phase, which is typically in the order of 0.05 second at the low frequencies of interest. However as a tag in a turbulent flow will tumble, it may not couple to the field produced by the reader antenna. In a turbulent flow it is likely that the tag changes its orientation during the read-out phase thus losing contact with the reader. While it is possible to shorten the read times by using higher frequencies, such frequencies have a higher attenuation in conductive fluids and are therefore not a practical solution for many oilfield applications.

A number of technologies have been proposed around the idea of sending some object or element up or down the borehole. A raw piece of semiconductor memory onto which data is written by a downhole device has been disclosed for example in GB Patent Application 1 549 307. A more sophisticated and robust vessel containing memory has been disclosed by GB Patent No 2, 352, 041 and U.S. Pat. No. 6,971, 265 assigned to Schlumberger Technology Corporation. Alternatively, even more complex vessels containing a variety of sensors and data storage have been disclosed. Examples of this solution can be found in GB Patent 2 352 042, co-pending U.S. patent application. Ser. No. 10/030,587 assigned to Schlumberger Technology Corporation, and U.S. Pat. No. 6,241,028.

U.S. Pat. No. 6,443,228 discloses the use of flowable devices in well bores to provide communication between surface and downhole instruments, among downhole devices, to establish a communication network in the well bore, to act as a sensor, and to act as power transfer devices. In some embodiments, the upward communication is proposed by writing information on the flowable devices downhole which are bound for the surface.

GB Patent No. 2 396 170 (incorporated herein by reference) discloses a well control system enabling the control of various downhole well control functions by instructions from the surface. The well or downhole tool conveyance mechanism can be used without necessarily being equipped with electrical power and control cables extending from the surface and without the use of complex and inherently unreliable mechanical shifting or push/pull techniques requiring downhole movement controlled remotely from the surface. The invention of this co-pending application makes use of downhole well control apparatus that is responsive to instructions from elements such as fluids or physical objects such as darts and balls that are embedded with tags for identification and for transmission of data or instructions. According to at least one disclosed embodiment, a downhole device may also write information to the element for return to the surface. In these disclosed embodiments, where information is being sent from a downhole location to the surface, information is written to the device (or acquired by the device itself) downhole.

U.S. Pat. No. 6,915,848, under obligation to assign to Schlumberger Technology Corporation (incorporated herein by reference) discloses a well control system enabling the control of various downhole well control functions by instructions from the surface without necessitating the well or downhole tool conveyance mechanism being equipped with electrical power and control cables extending from the surface and without the use of complex and inherently unreliable mechanical shifting or push/pull techniques requiring downhole movement controlled remotely from the surface. The invention of this co-pending application makes use of downhole well control apparatus that is response to instructions from elements such as fluids or physical objects such as darts and balls that are embedded with RF tags for identification and for transmission of data or instructions. According to at least one disclosed embodiment, a downhole device may also write information to the element for return to the surface.

GB Patent No. 2 396 170 discloses a downhole communication system with a plurality of releasable vessels positioned at downhole locations, the vessels containing signal information affixed to the vessels prior to placement of the vessels downhole, and the signal information indicating the presence of at least one of three or more predetermined downhole conditions. A detecting system is positioned on the surface such that the signal information can be detected on one or more of the vessels. A processing system is located on the surface and is programmed to establish the presence of the predetermined downhole condition based on the signal information. The vessels can carry RF tags.

In the light of the above prior art, it is seen as an object of the present invention to provide RF based communication devices with improved read-out capabilities for use in turbulent flows. It is seen as a further object of the invention to provide tags that are more stable during a read-out phase.

SUMMARY OF THE INVENTION

According to a first aspect of the invention there is provided a system and vessels for communicating information from a downhole location in a hydrocarbon borehole to the surface with one or more releasable vessels positioned at the downhole location, the vessels carrying radio frequency (RF) activated circuitry and conveying signal information indicative of downhole conditions or parameters, and a RF reading system on the surface positioned and adapted to detect presence and/or the signal information of the one or more vessels, the vessels being adapted to maintain RF coupling with the reader in a fluid flow, particularly in a turbulent flow.

In other words the invention provides means to counter or reduce the effect of a turbulent flow on the read-out of RFID tags.

The fluid flow to which the vessels of the invention are best adapted to can be characterized as at least temporarily turbulent. Turbulent is understood to mean a flow beyond its laminar flow range. RF circuitry or tags are incorporated into the vessel, which in turn floats passively within the well bore liquid.

The RF frequency range best suitable for use in conductive water and oil flow is within the lower range of radio frequencies. A preferred range is 40 to 500 kHz. A more preferred range is 80 to 300 kHz.

The vessels, also referred to herein as passive autonomous devices, preferably encapsulate the tag in such a way as to allow its survival in the challenging downhole environment and facilitate the collection of data without interrupting the well bore flow.

For an inductively coupled tag to be read, its antenna must be aligned with the magnetic field produced by the reader. As the device moves in the flow, it experiences torque due to turbulence. This force, acting in ever changing directions and magnitudes, will cause the object to spin randomly, therefore preventing the data being read from the enclosed tag. In order for reading to be possible, the spin must be controlled or, alternatively, the read-out must be less sensitive to the rotation of the tag.

Therefore according to a further aspect of the invention, an RFID tag of the invention may include two, three or more antennas, each antenna generating a preferred spatial direction for coupling to a reader antenna different from the other antennas. Each of the antennas can be regarded as dipole with a respective emission and/or reception characteristic. By orienting the antennas and hence the dipoles in different spatial, preferably orthogonal directions, any rotation of the RFID tag or device is compensated for by a coupling of another antenna to the stationary receiver.

In a preferred embodiment of this aspect of the invention, the antennas are connected by an electronic circuit designed to pass through to the RFID tag the signal from the antenna with the strongest coupling and, hence, best reception from the reader antenna.

In a further preferred variant of this embodiment, the antennas are coupled by half bridge or full bridge rectifiers. The rectifiers can be assembled from passive elements such as diodes, however, an equivalent transistor circuit or more complex electronic circuitry may be used to couple the antennas at the expense of higher power consumption.

According to another aspect of the invention, the carrier of the RFID tag is stabilized in the turbulent flow by establishing a preferred orientation of the device. This is preferably achieved using a carrier or device that assumes a preferred orientation in either the force field generated by the flow itself or by the gravity field.

According to a preferred embodiment of this aspect of the invention the device has a geometry and weight distribution such that a force field like fluid drag or gravity generates a torque that rotates the device into its preferred orientation.

A possible method of achieving this is to ensure the device has a non-uniform density creating a stabilizing torque. If the stabilizing torque is greater than the perturbations due to the turbulence, the orientation of the device can be stabilized in a preferred orientation. The orientation is chosen to optimize the coupling with a reader coil.

A number of different configurations are feasible to achieve this effect, however, in a preferred variant the device is essentially spherical with the centre of mass offset from the geometrical centre of the sphere. The term essentially spherical includes elliptical, oval or similar shapes. However, it was found that the spherical shape is the least sensitive to turbulent effects.

The device is preferably buoyant in the flow into which it is released. More preferable, it has a density of less than 1.1 g/ccm. Even more preferable, it has a density of 0.7 to 1.0 g/ccm. Hence, mean or average density of the device is preferably less than or equal to water. The device can be for example manufactured using fluid-filled capsules of heat and pressure resistant non-conductive material such as glass or epoxy loaded capsules with a small amount of high-density material at an off-centre position.

To withstand the pressure in the well while maintaining sufficient buoyancy, the device preferably includes sections or parts of a castable hardening material, such as epoxy resin, loaded or filled with hollow particles, such as glass microbubbles.

According to a further aspect of the invention, the reader antenna is located inside a metal conveyance system. In the case of hydrocarbon exploration and production, the metal conveyance system includes sections of steel pipe at the entry of the well. The antenna preferably includes a solenoid placed at the inner wall of the pipe but isolated from it by a layer of ferrite material.

These and other aspects of the invention will be apparent from the following detailed description of non-limitative examples and drawings.

BRIEF DESCRIPTION OF THE DRAWINGS

FIGS. 6A-C are variants of devices or vessels for RFID tags in accordance with examples of the invention.

DETAILED DESCRIPTION

Examples

Figure 1:
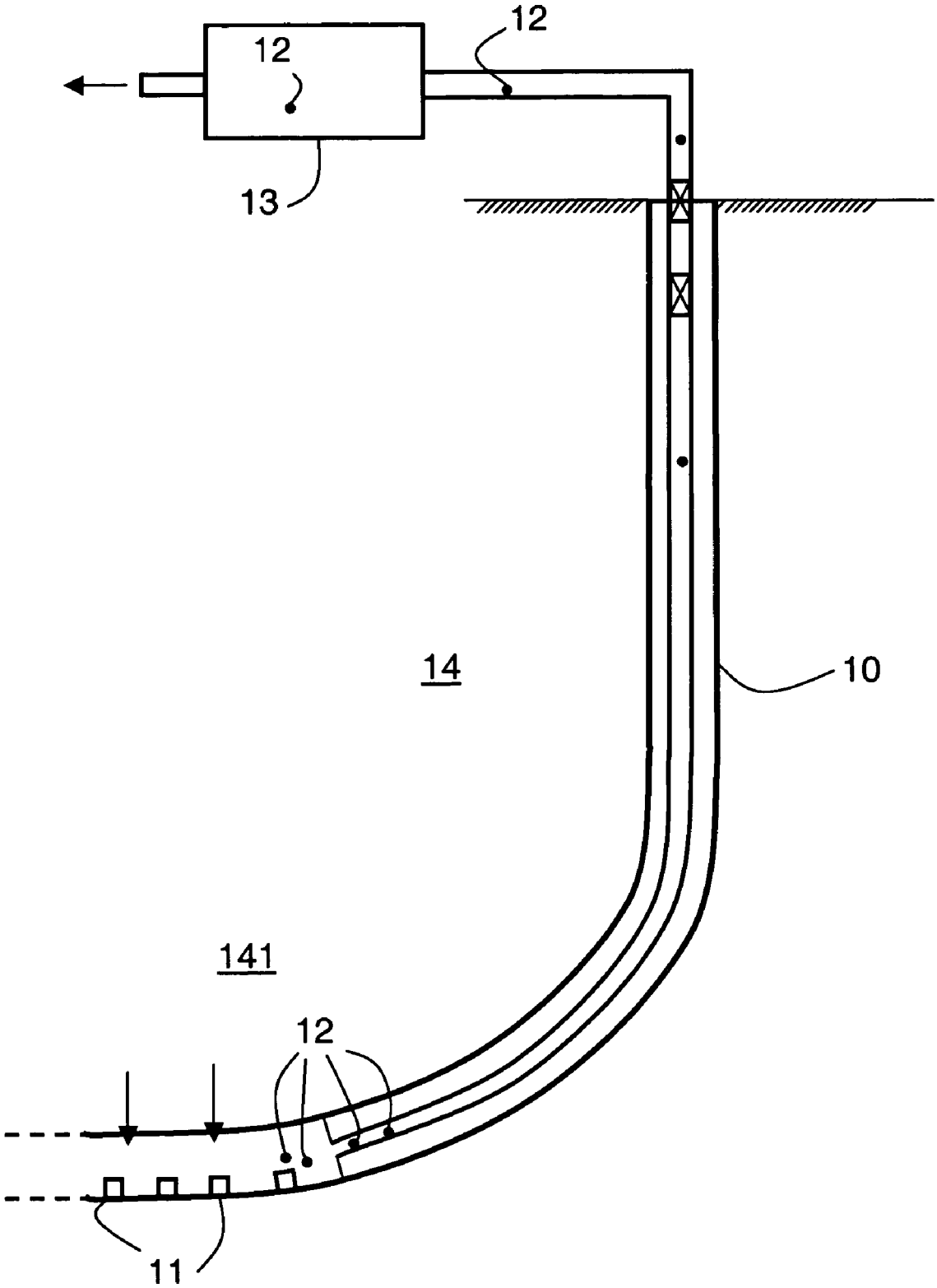
FIG. 1 shows a subterranean well bore completion system with a reservoir of RFID tags released in intervals to carry information to the surface.

In FIG. 1 there is shown a system for communicating information from downhole to the surface. The system generally comprises one or more downhole sensors and associated release mechanisms 11, floating passive autonomous devices or vessels 12, and surface detection system 13. There are four sensor/release mechanisms 11 positioned in the lower end of well 10. Well 10 is producing hydrocarbons from reservoir region 141 in the earth 14. The vessels 12 are constructed to have a high probability of surviving downhole pressures and temperatures, and will be carried to the surface by the flowing liquids in the well 10. Surface detection system 13 detects and/or recovers vessels and interprets the signals conveyed by vessels 12.

Figure 2A:
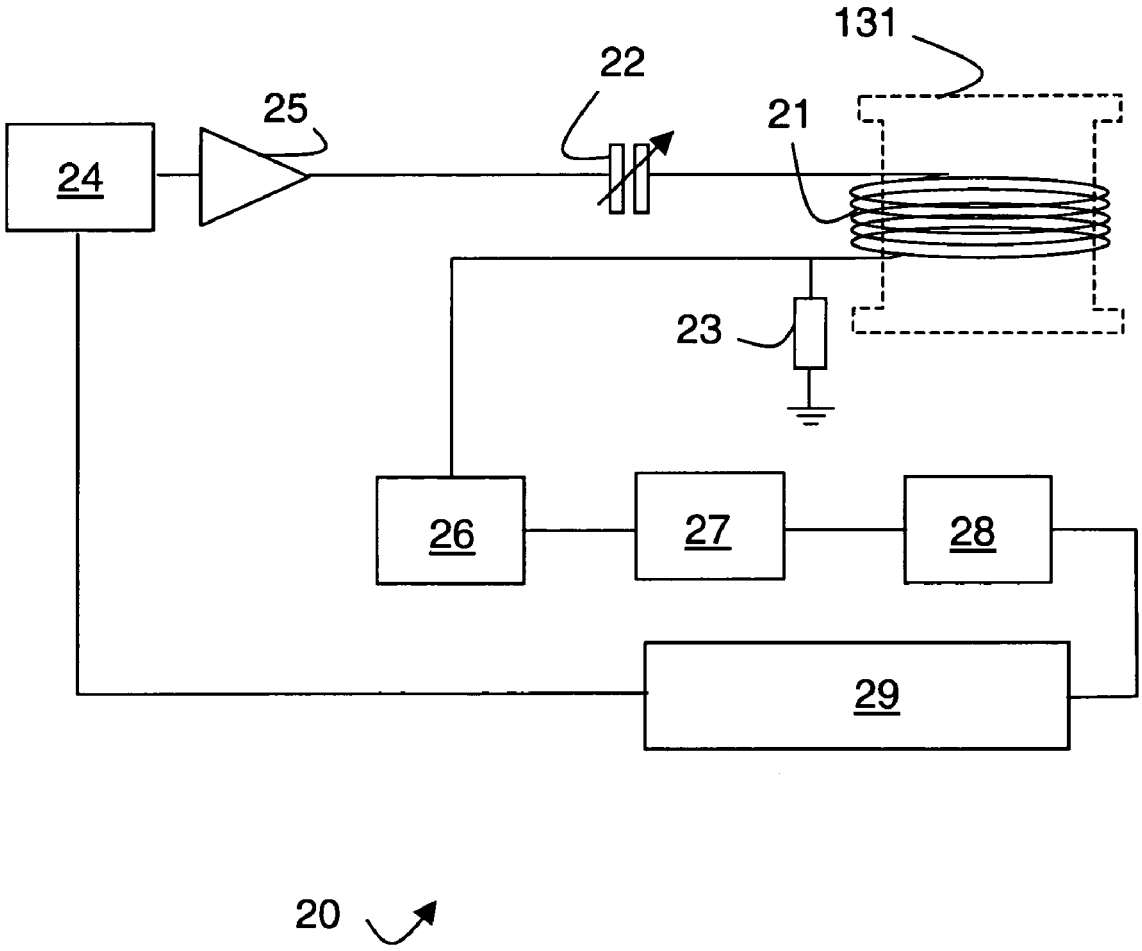
FIG. 2A is a diagram of a reader antenna circuit for energizing and read-out of RFID tags.

Reader circuit 20 of surface detection system 13 is shown in greater detail in FIG. 2A. The reader circuit includes reader coil 21 of 170 mm length and 90 mm diameter. It is wound with approximately 440 turns of 0.3 mm insulated copper wire mounted onto a flow pipe 131 in a manner shown in FIG. 2B below. The coil has an inductance of 7.8 mH and a resistance of 27.8 Ohms. To allow for fine adjustment of the resonance frequency, parallel network 22 of fixed capacitor (150 pF) and adjustable capacitor (15-65 pF) is used.

The coil and capacitor have a calculated Q of 218, which results in a bandwidth of 568 Hz. To dampen the resonance and thus increase the bandwidth, resistor 23 (510 Ohms) is added in series with coil 21 and capacitor network 22. This reduces Q to 11.3 and increases the bandwidth to 10 kHz. Damping resistor 23 is also used to sense the current flow through coil 21. Coil 21 is driven by signal generator 24 and amplifier 25. The tuning of the coil to a specific frequency is best done in-situ on the flow from the well, as the resonance shifts with the fluid in the flow.

A demodulation circuit includes diode detector 26 to half-wave rectify the signal and remove the carrier signal as generated by signal generator 24 and amplifier 25. Diode detector 26 includes a RC network acting as a low pass filter and DC component blocking circuit. The output of diode detector 26 is fed into low path filter and amplifier 27. The low path filter has a corner frequency of 20 kHz. The filtered and amplified signal is then fed into comparator 28 the level of which was set just above background noise. The comparator lifts the signal to TTL levels via a Schmitt gate.

The TTL level data stream is fed into processor board 29 carrying processor and memory together with I/O ports to decode the signal and covert it into machine-readable data. Processor board 29 also controls signal generator 24.

Figure 2B:
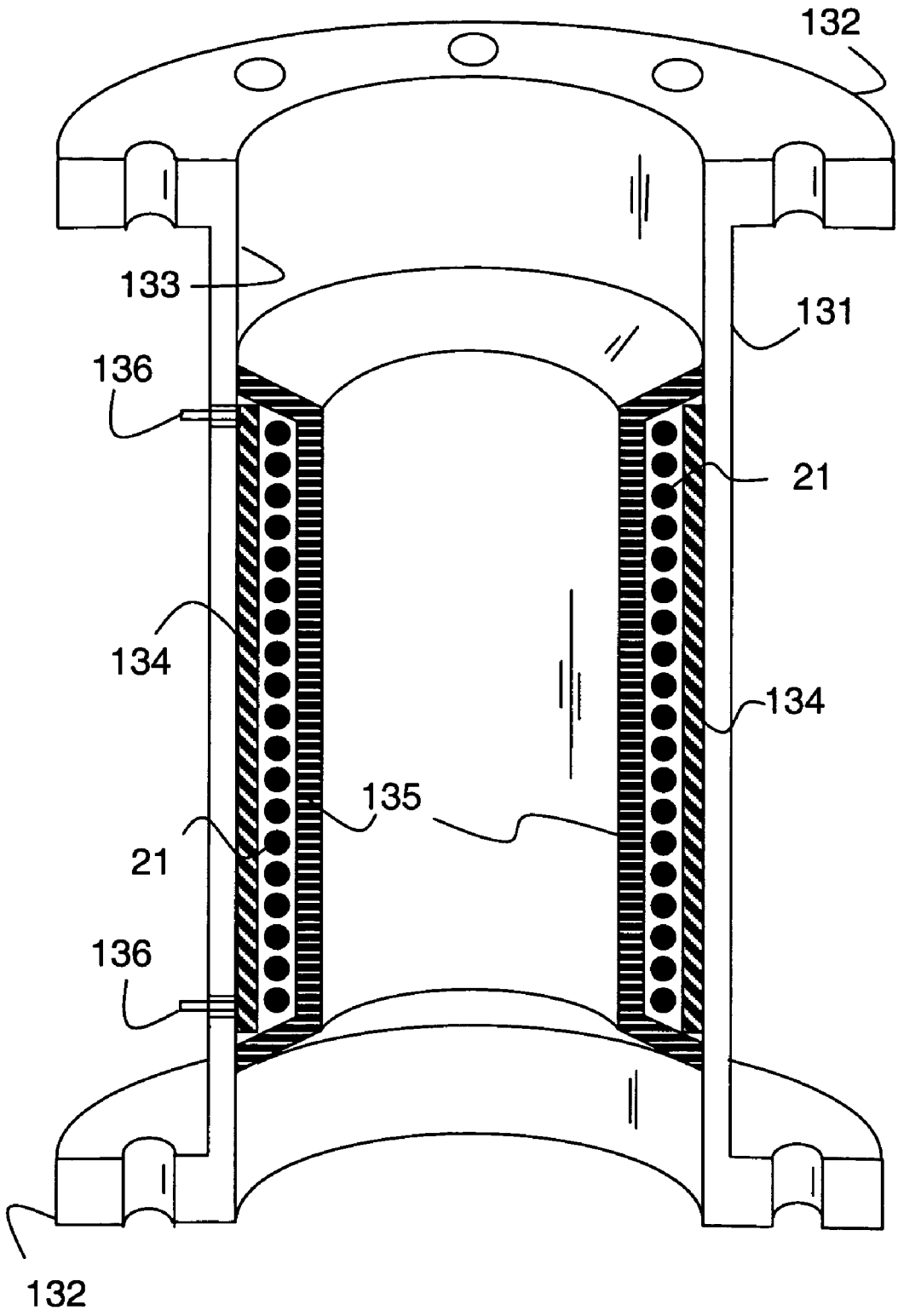
FIG. 2B is a horizontal cut through a schematic perspective view of a surface pipe section including a reader antenna in accordance with an aspect of the invention.

An arrangement to house coil 21 inside a metal section of surface pipe 131 is shown in FIG. 2B.

It is beneficial to isolate the reader coil from the enclosing pipe to prevent the occurrence of large eddy currents. Thus, part of inner surface 133 of the pipe is sheathed with layer 134 of ferrite. The ferrite material may be chosen from commercially available material, such as manganese-zinc or nickel-zinc. Sheath 134 of ferrite material separates coil 21 from metal pipe section 131 thereby reducing the eddy current losses and radiation emission. In the example shown, concentrically mounted inner pipe 135 protects the coil from being damaged by abrasive material carried along with the fluid flow. Inner pipe 135 is made of reinforced polyetheretherketone (PEEK). Two connectors 136 provide an electrically conductive path to the exterior of pipe 131. Pipe section 131 terminates in flanges 132.

Instead of using a ferrite sheath, pipe section 131 can be made of high-strength, non-conductive materials, in which case reader coil 21 is wound around the exterior of the pipe. Suitable materials for such non-conductive pipe include ceramics and composites like reinforced PEEK.

In operation, coil 21 generates an axial magnetic field. Magnetic fields in diametrical direction, if required, may be generated using an extra layer of conductors (not shown) running in axial direction along the inside of ferrite sheath 134. The magnetic field is to a large extent confined to the interior of pipe 131. Ferrite layer 134 reduces losses of energy in the wall of steel pipe 131 through eddy currents or other residual losses.

Whilst the above configuration improves the reader antenna, it is another aspect of the invention to enhance the read-out by improving the vessel to be less sensitive to the flow turbulence.

In FIG. 3 there are shown two different antenna configurations to improve the efficiency of the coupling of a tag to the reader coil.

Figure 3A:
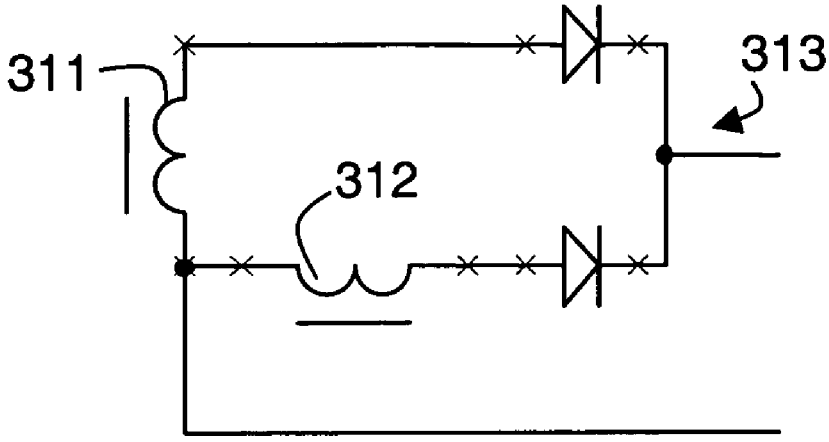
FIGS. 3A,B show circuit diagrams of the antenna of tags in accordance with an example of the invention.
Figure 3B:
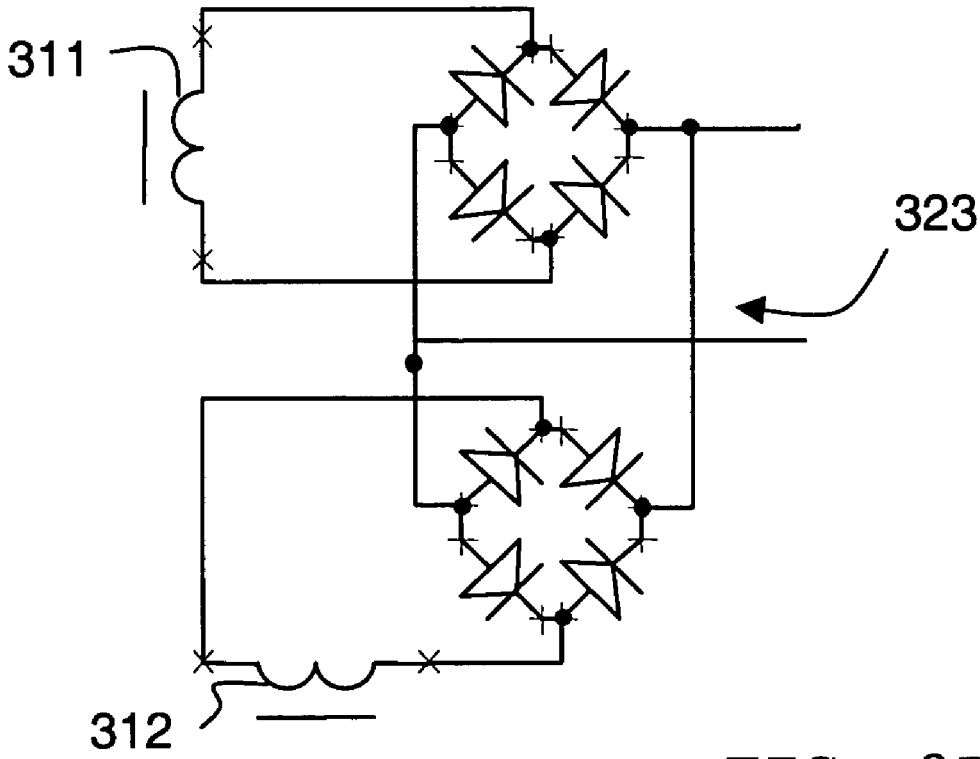

Two mutually orthogonally oriented antennas 311, 312 are shown in FIG. 3A connected by a rectifier in a half-bridge configuration 313. In FIG. 3B, full-bridge 323 replaces half-bridge 313 of FIG. 3A. The diodes used in both configurations have a low forward voltage drop, e.g., Schottky diodes. The full-bridge configuration has a higher component count.

Figure 4:
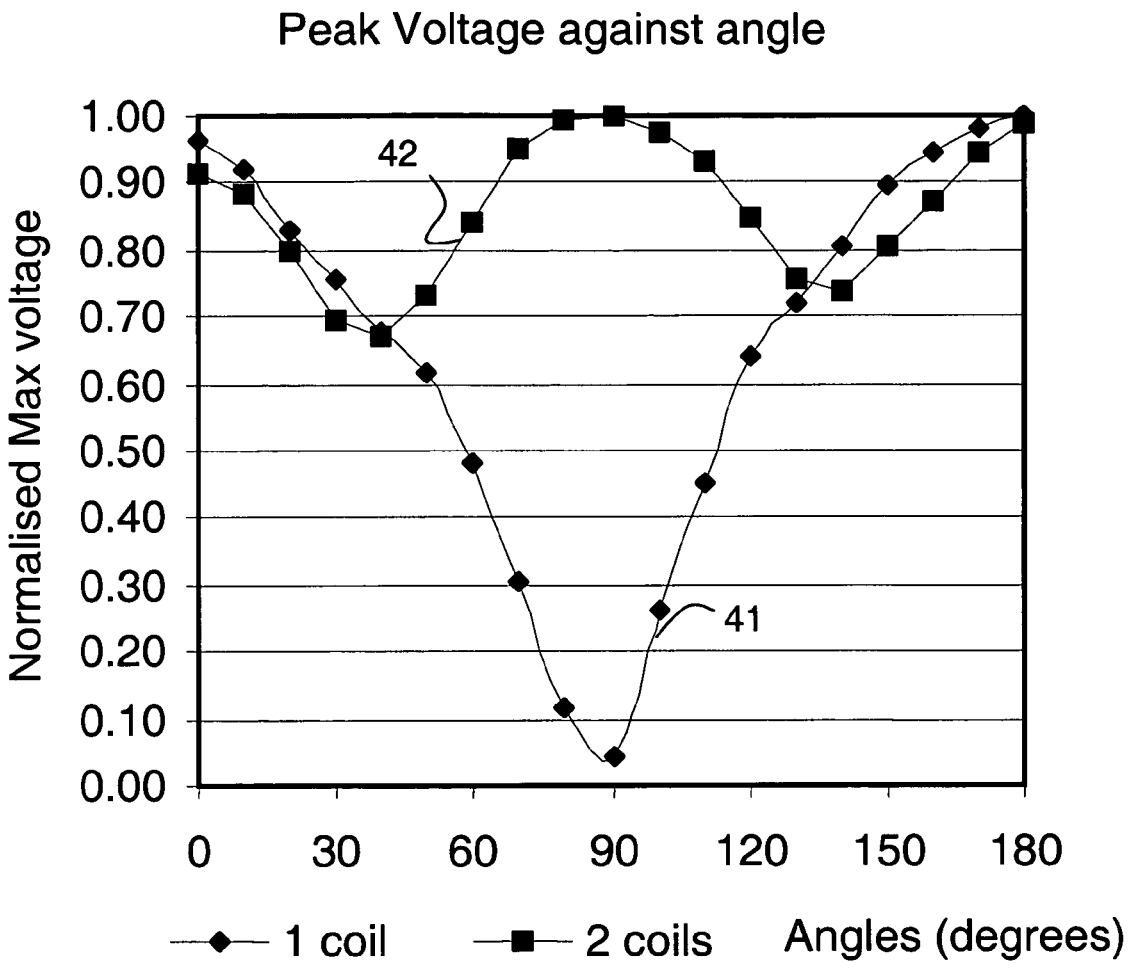
FIG. 4 compares the signal strength of a conventional tag with a tag using a design in accordance with the invention.

Using the antenna configuration of FIG. 3A, i.e., half-bridge rectifier 313 to couple the two orthogonal antennas 311, 312, the peak output voltages varies by less than 30 percent as the tag is rotated in a (constant) magnetic field. In FIG. 4 this effect is demonstrated with lower curve 41 indicating the peak output voltage from a single coil device. Upper curve 42 indicates the output from the two-coil device.

Figure 5:
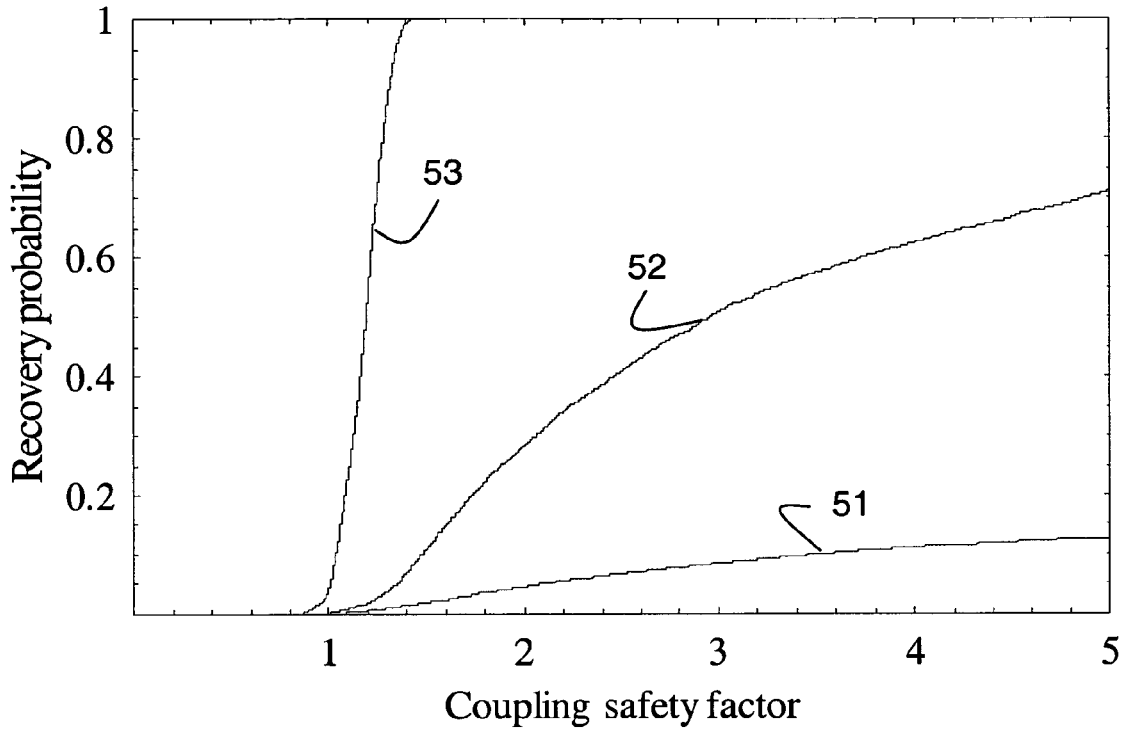
FIG. 5 illustrates the improvements in data recovery probability afforded by tags using a design in accordance with the invention.

A Monte Carlo simulation illustrated by FIG. 5 can evaluate the effectiveness of the dual antenna configuration shown in FIG. 3 and a treble antenna configuration, which is not shown in FIG. 3. However, the treble antenna configuration can be regarded as an extension of the dual antenna configuration with a third antenna mounted with an orientation orthogonal to those of the other two antennas.

Assuming that the antenna is spinning around an axis that is randomly orientated with respect to both the exciting field and one of the antennas, the probability can be estimated for a tag being read as a function of the exciting field. This field is measured in units of the field necessary to read the tag when it's most favorably orientated. The single antenna (curve 51 of FIG. 5) has a low probability, remaining below 20 percent even at high field strengths. The dual antenna (curve 52 of FIG. 5) is not one hundred percent effective because there is a chance that it will spin around an axis that is normal to its plane and also along the field. The treble antenna (curve 53) is easily one hundred percent effective once the necessary field strength is reached.

The read-out efficiency of the devices of the present invention in a turbulent flow environment can be further improved by a strong asymmetry that generates a torque on the device itself when placed in a force field.

It is feasible to create such an asymmetry through the outer shape of the device by, for example, stabilizers such as fins and tails. However, for application in well bores and wellbore pipes, deviation from an approximately spherical shape may cause extended devices to get stuck. The invention therefore contemplates a way of rendering a spherical shape such that a preferred orientation in a turbulent flow is accomplished.

In FIG. 6A there is shown the cross-section of hollow (sacrificial) polypropylene shell 61 acting as the carrier of RFID tag 62. The tag is embedded in matrix 63 of low-density epoxy resin having a density of 0.62 g/ccm and being rated for temperatures up to 180 degrees Celsius. A second part 64 of sphere 61 is filled with a much denser material. This denser material is preferably electrically non-conductive to not interfere with the electromagnetic field of the reader. A suitable material is Barium sulphate powder with a bulk density of 4.5 g/ccm. As compacted powder, the density drops but remains above 2 g/ccm. The two parts of the sphere are glued together using the setting reaction of the epoxy filling.

The thus weighted sphere has an average density of 0.8 g/ccm thus being slightly buoyant in a mixture of oil and water. It has a torque that can be calculated by integration of the density distribution times the distance from the center of the sphere. The stabilizing torque acts to turn the sphere such that the cap 64 of barite is located at the bottom.

The above example of FIG. 6A can be further refined to increase the torque. One way of increasing the torque is to increase the difference in density of cap material 64 and of matrix or body material 63. In the device of FIG. 6B, the body material includes two layers 65, 66 of powder filling. The layer 65 is a low-density epoxy powder with the trade name Expancel supplied by Boud Minerals & Polymers of Marsden, Kent, England. The powder has a very low density of 0.03 g/ccm. The epoxy material used in the example of FIG. 6A above serves as intermediate layer 66. Tag 62 and barite cap 64 remain unchanged from the example of FIG. 6A.

The above examples of FIGS. 6A and 6B have a shell 61 and an epoxy filling that may collapse under higher pressure. In an improved variant of the invention, as illustrated by FIG. 6C, the shell is replaced by a molded sphere.

In the example of FIG. 6C, the sphere comprises a first section 67 made of Bisphenol-A based epoxy using 50 micron diameter hollow glass beads 671 (commercially available from 3M™) as filler material. Tag 62 and barite cap 64 remain unchanged from the example of FIG. 6A.

The barite may be replaced by higher density materials such as tungsten oxide (density 7.1 g/ccm).

The devices of FIG. 6 have an improved read-out probability in a turbulent flow. In FIG. 7, a comparison is illustrated of the vertical projection of the tag inside a sphere in a turbulent vertical flow. The vertical projection can be regarded as a measure indicating a possible read-out. It is conservatively estimated that a read-out is possible when the tag is inclined less than 30 degrees from the vertical axis, equivalent to a value of approximately 0.87 in the plots of FIG. 7. This threshold is shown as horizontal line 71 of marks. Scattered marks 72 show the orientation of the device as measured.

Figure 7A:
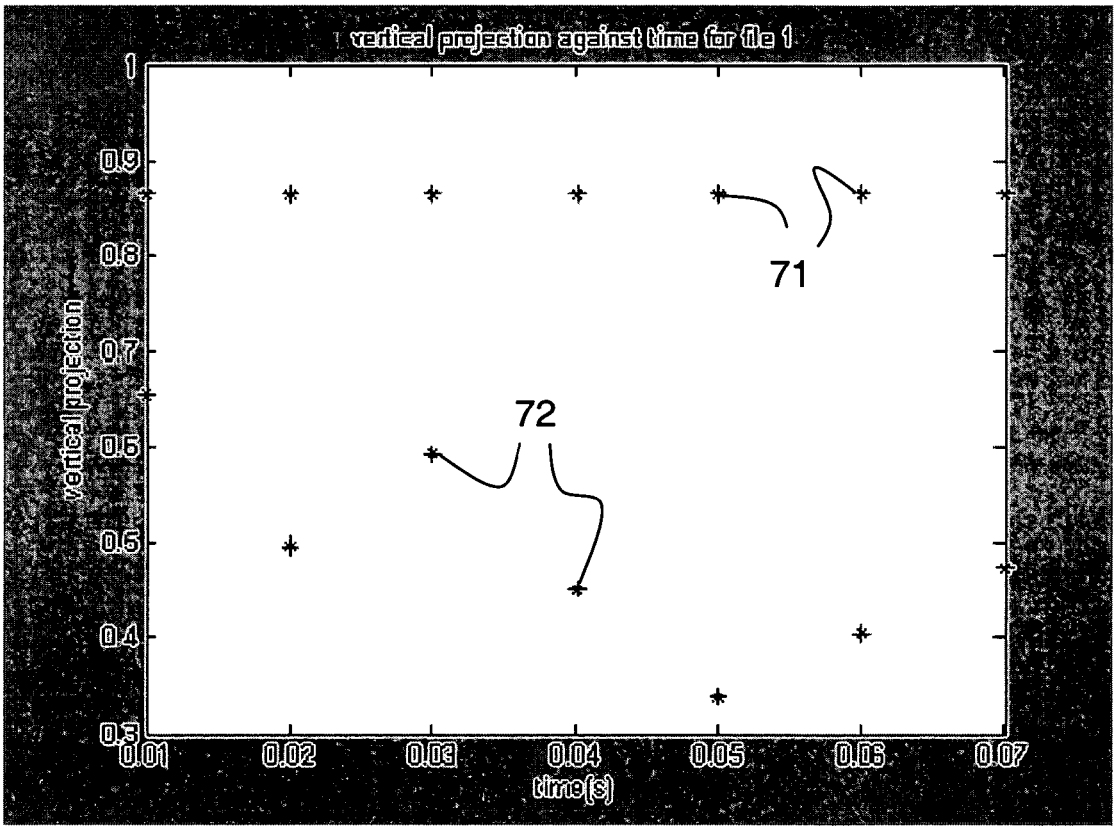
FIGS. 7A,B compare the orientations of tags in a turbulent flow.

In the example of FIG. 7A, the spherical device has a homogeneous weight distribution and hence a low torque. The orientation is found to be scattered between projection values of 0.3 to 0.65. The vertical projection never rises above the level required to read a tag reliably.

Figure 7B:
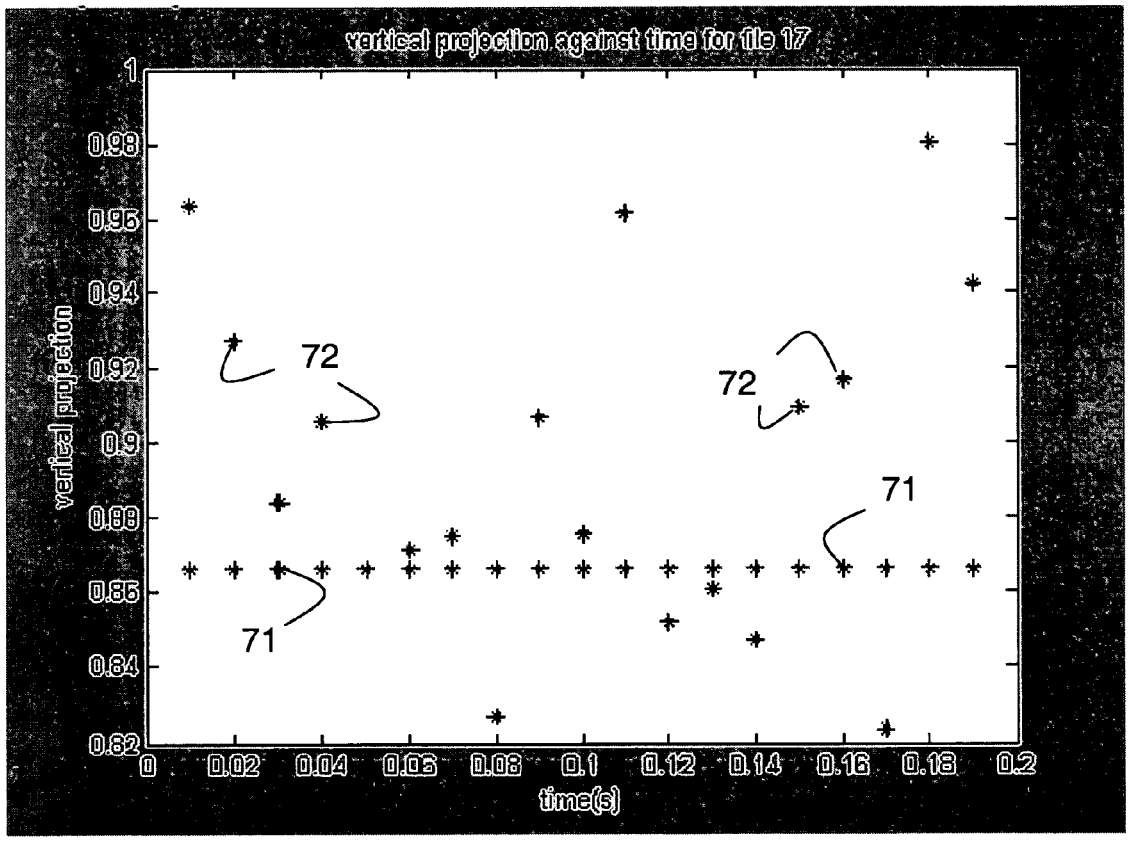

In the example of FIG. 7B, the sphere has an asymmetric weight distribution as described above. The torque caused by the gravity force field is sufficient to increase the vertical projection values 72 above threshold level 71 under most circumstances.

While the invention has been described in conjunction with the exemplary embodiments described above, many equivalent modifications and variations will be apparent to those skilled in the art when given this disclosure. Accordingly, the exemplary embodiments of the invention set forth above are considered to be illustrative and not limiting. Various changes to the described embodiments may be made without departing from the spirit and scope of the invention.

The invention claimed is:

1. A vessel for communicating information through a fluid flow comprising radio frequency (RF) circuitry responsive, when in use, to an RF reader system, the vessel having a geometry and weight distribution to provide that the vessel maintains a preferred orientation as the vessel flows in the fluid flow, the preferred orientation being selected to provide for coupling the RF circuitry with the reader system, wherein the vessel comprises of castable material with embedded hollow particles.

2. The vessel of claim 1 comprising more than one RF antenna.

3. The vessel of claim 1 comprising more than one RF antenna, wherein RF antennas are coupled through rectifiers.

4. The vessel of claim 1 comprising more than one RF antenna, wherein RF antennas are coupled through half-bridge rectifiers.

5. The vessel of claim 1 comprising more than one RF antenna, wherein RF antennas are coupled through full-bridge rectifiers.

6. The vessel of claim 1 wherein the vessel has a center of a mass distant from its geometrical center.

7. The vessel of claim 1 having an average density in the range of 0.5 to 1.2 g/ccm.

8. The vessel of claim 1 having an average density in the range of 0.7 to 1.0 g/ccm.

9. The vessel of claim 1 having an average density in the range of 0.7 to 0.99 g/ccm.

10. The vessel of claim 1 having an essentially spherical shape.

11. The vessel of claim 1 having a spherical shape.

12. The vessel of claim 1 wherein the castable material is epoxy-based.

13. The vessel of claim 1 wherein embedded hollow particles are glass micro beads.

14. A system for communicating information from a downhole location in a hydrocarbon borehole to the surface comprising:

one or more releasable vessels having radio frequency (RF) circuitry responsive, when in use, to an RF reader system, the one or more releasable vessels each having a geometry and weight distribution to provide that the vessel maintains a preferred orientation as the vessel flows in the fluid flow, the preferred orientation being selected to provide for coupling the RF circuitry with the reader system, a reader antenna located within a section of a surface pipe, wherein the reader antenna is configured to couple with the RF circuitry when the vessel is in the preferred orientation, and wherein a ferrite material separates at least part of the antenna from the surface pipe.

15. A system according to claim 14 further comprising a releasing system adapted to release the vessels at the occurrence of a predetermined event or time.

16. The vessel of claim 1 wherein the vessel is configured to maintain the preferred orientation when the fluid flow is a turbulent flow.

* * * * *